US007427837B2

(12) United States Patent
Kim

(10) Patent No.: US 7,427,837 B2
(45) Date of Patent: Sep. 23, 2008

(54) REAR PLATE FOR PLASMA DISPLAY PANEL WITH BARRIER RIBS HAVING SPECIFIC WIDTH CHARACTERISTICS

(75) Inventor: Woong-Sik Kim, Gumi (KR)

(73) Assignee: LG Micron Ltd., Gumi, Gyeongsang Buk-Do (KR)

( * ) Notice: Subject to any disclaimer, the term of this patent is extended or adjusted under 35 U.S.C. 154(b) by 514 days.

(21) Appl. No.: 10/537,763

(22) PCT Filed: Dec. 10, 2002

(86) PCT No.: PCT/KR02/02319

§ 371 (c)(1),
(2), (4) Date: Jun. 6, 2005

(87) PCT Pub. No.: WO2004/053916

PCT Pub. Date: Jun. 24, 2004

(65) Prior Publication Data

US 2006/0049756 A1 Mar. 9, 2006

(30) Foreign Application Priority Data

Dec. 9, 2002 (KR) ..... 10-2002-0077653

(51) Int. Cl.
*H01J 17/49* (2006.01)
*H01J 19/42* (2006.01)

(52) U.S. Cl. ..... 313/586; 313/292

(58) Field of Classification Search ..... 313/582–587, 313/238, 292; 345/60; 445/24, 25
See application file for complete search history.

(56) References Cited

FOREIGN PATENT DOCUMENTS

| | | | |
|---|---|---|---|
| JP | 12-169764 | A | 6/2000 |
| JP | 15-2692 | A | 1/2003 |
| WO | WO-98/01885 | A1 | 1/1998 |
| WO | WO-99/10909 | A1 | 3/1999 |
| WO | WO-99/24999 | A1 | 5/2000 |

*Primary Examiner*—Joseph L Williams
(74) *Attorney, Agent, or Firm*—Birch, Stewart, Kolasch & Birch, LLP

(57) ABSTRACT

Disclosed is a rear plate of a plasma display panel. In the rear plate, barrier ribs are formed by etching a baked barrier rib layer, so that the completed barrier ribs have no deformation and the electrodes can be exactly located at central portions between the barrier ribs. In a PDP having a front plate to a rear plate attached to each other, the PDP shows improvements in both optical characteristics, such as average brightness, color temperature, and contrast, and electric characteristics, such as voltage margin, power consumption, and efficiency.

8 Claims, 9 Drawing Sheets

REAR PLATE FOR PLASMA DISPLAY PANEL WITH BARRIER RIBS HAVING SPECIFIC WIDTH CHARACTERISTICS

TECHNICAL FIELD

The present invention relates to a rear plate of a plasma display panel.

BACKGROUND ART

As generally known in the art, a plasma display panel (PDP) is a display device having a front glass substrate and a rear glass substrate between which a discharge space is formed, so that plasma discharge may be generated in the discharge space, thereby causing phosphors in the discharge space to be excited and emit light, so as to display a screen.

PDPs may be classified into direct current plasma display panels (DC PDPs) and alternating current plasma display panels (AC PDPs), from among which the AC PDPs are the mainstream. U.S. Pat. No. 5,446,344, assigned to Fujitsu co., Ltd., discloses a three-electrode surface-discharge alternating-current plasma display panel which is one of the representative AC PDPs.

A PDP includes a front plate and a rear plate assembled in parallel with each other. The front plate includes a front glass substrate, transparent electrodes formed on a lower surface of the front glass substrate, each of the transparent electrodes including a scan electrode and a sustain electrode, bus electrodes formed on lower surfaces of the transparent electrodes so as to reduce resistance of the transparent electrodes, a dielectric layer covering the transparent electrodes and the bus electrodes, and a magnesium oxide layer formed on a lower surface of the dielectric layer so as to prevent sputtering of the dielectric layer and facilitate discharge of secondary electrons. Further, the rear plate includes a rear glass substrate, address electrodes, a dielectric layer, barrier ribs for forming discharge compartments between the front and rear plates, and phosphorous layers.

In general, a rear plate of a PDP as described above is manufactured by sand blasting similar to a method of forming a thick film pattern on a substrate of a PDP, which is disclosed by Japanese Patent Laid-Open No. P5-128966.

The conventional rear plate manufactured using the sand blasting as described above has the following shortcomings.

First, in the sand blasting method as described above, barrier ribs are preliminary formed in a shape of patterns, and are then baked. As a result, while the barrier ribs are baked, the barrier ribs may be distorted and deformed. Therefore, it is difficult to exactly locate each electrode on a central position between two barrier ribs, which is a desired position for each electrode.

Second, in the sand blasting, SiO2 or CaCO3 is sprayed onto a barrier rib layer by compressed air or a centrifugal force, to form the barrier ribs. However, when each of the barrier ribs has a width of smaller than 60 μm, the barrier ribs may collapse.

Third, the conventional PDP having a front plate and a rear plate attached to each other has deteriorated electric and optical characteristics.

DISCLOSURE OF THE INVENTION

Therefore, the present invention has been made in view of the above-mentioned problems, and it is an object of the present invention to provide a rear plate of a plasma display panel, in which each electrode can be exactly located on a central portion between barrier ribs.

It is another object of the present invention to provide a rear plate of a plasma display panel, which can improve electric and optical characteristics of the plasma display panel.

According to an aspect of the present invention, there is provided a rear plate of a plasma display panel, the rear plate comprising: a glass substrate; electrodes formed in a shape of patterns on an upper surface of the glass substrate; a dielectric layer formed on upper surfaces of the electrode and the upper surface of the glass substrate; barrier ribs formed in a shape of a pattern through etching on an upper surface of the dielectric layer; and phosphorous layers formed on side surfaces and bottom surfaces of the barrier ribs, to emit visible rays according to electric signals, wherein: each of the electrodes includes an effective electrode portion formed at a central portion of the glass substrate to apply an address signal, an electrode pad portion formed at a peripheral portion of the glass substrate and connected with a driving circuit to transfer a signal, and an electrode connecting portion interconnecting the effective electrode portion and the electrode pad portion, and has a specific resistance of 2.5×10−6~4×10−6Ωcm; the dielectric layer covers all of the effective electrode portion and a part of the electrode connecting portion of each electrode, and is made from complex of glass and ceramic filler, which has a dielectric constant of 8~20, a reflectance of 50~80%, an etching rate of 0.03~0.8 μm/min with respect to inorganic acid, and a thickness of 10~30 μm; the barrier ribs are formed in a shape of stripes on the upper surface of the dielectric layer while being located between the effective electrode portions, and are made from complex of glass and ceramic filler, which has a dielectric constant of 7~18, a reflectance of 40%~70%, an etching rate of 1.0~30.0 μm/min with respect to inorganic acid, and a thickness of 100~160 μm, and each of the barrier ribs meets conditions, A/B=0.67~1.25 and B/C=0.32~1.0, wherein A, B, and C represent width of an uppermost portion, a middle portion, and a lowermost portion of each barrier rib, respectively; and each of the phosphorous layers has a thickness of 10~30 μm.

In this case, it is preferred that the barrier ribs are spaced either equal intervals or unequal intervals apart from each other.

Further, it is preferred that protrusions are formed on side surfaces of the barrier ribs opposed to each other.

According to another aspect of the present invention, there is provided a rear plate of a plasma display panel, the rear plate comprising: a glass substrate; electrodes formed in a shape of patterns on an upper surface of the glass substrate; a dielectric layer formed on upper surfaces of the electrode and the upper surface of the glass substrate; barrier ribs formed in a shape of a pattern through etching on an upper surface of the dielectric layer; and phosphorous layers formed on side surfaces and bottom surfaces of the barrier ribs, to emit visible rays according to electric signals, wherein: each of the electrodes includes an effective electrode portion formed at a central portion of the glass substrate to apply an address signal, an electrode pad portion formed at a peripheral portion of the glass substrate and connected with a driving circuit to transfer a signal, and an electrode connecting portion interconnecting the effective electrode portion and the electrode pad portion, and has a specific resistance of 2.5×10−6~4×10−6Ωcm; the dielectric layer covers all of the effective electrode portion and a part of the electrode connecting portion of each electrode, and is made from complex of glass and ceramic filler, which has a dielectric constant of 8~20, a reflectance of 50~80%, an etching rate of 0.03~0.8 μm/min with respect to inorganic acid, and a thickness of 10~30 μm; the barrier ribs are formed in a shape of matrix on the upper surface of the dielectric layer while being located between the effective electrode portions, and are made from complex of glass and ceramic filler, which has a dielectric constant of 7~18, a reflectance of 40%-70%, an etching rate of 1.0~30. 0 μm/min with respect to inorganic acid, and a thickness of 100~160 μm, and each of the barrier ribs meets conditions, A/B=0.67~1.25 and B/C=0.32~1.0, wherein A, B, and C represent width of an uppermost portion, a middle portion, and a lowermost portion of each barrier rib, respectively; and each of the phosphorous layers has a thickness of 10~30 μm.

In this case, it is preferred that the barrier ribs are spaced either equal intervals or unequal intervals apart from each other.

Further, it is preferred that, when the transverse direction of the barrier ribs 146 is given as an X direction and the longitudinal direction thereof is given as a Y direction, thickness of each of the barrier ribs in the X direction is different from thickness thereof in the Y direction.

In the rear plate, barrier ribs are formed by etching a baked barrier rib layer, so that the completed barrier ribs have no deformation and the electrodes can be exactly located at central portions between the barrier ribs.

In a PDP having a front plate to a rear plate attached to each other, the PDP shows improvements in both optical characteristics, such as average brightness, color temperature, and contrast, and electric characteristics, such as voltage margin, power consumption, and efficiency.

BRIEF DESCRIPTION OF THE DRAWINGS

The foregoing and other objects, features and advantages of the present invention will become more apparent from the following detailed description when taken in conjunction with the accompanying drawings in which.

BEST MODE FOR CARRYING OUT THE INVENTION

Hereinafter, a rear plate of a plasma display panel according to a preferred embodiment of the present invention will be described in detail with reference to the accompanying drawings.

Figure 1:
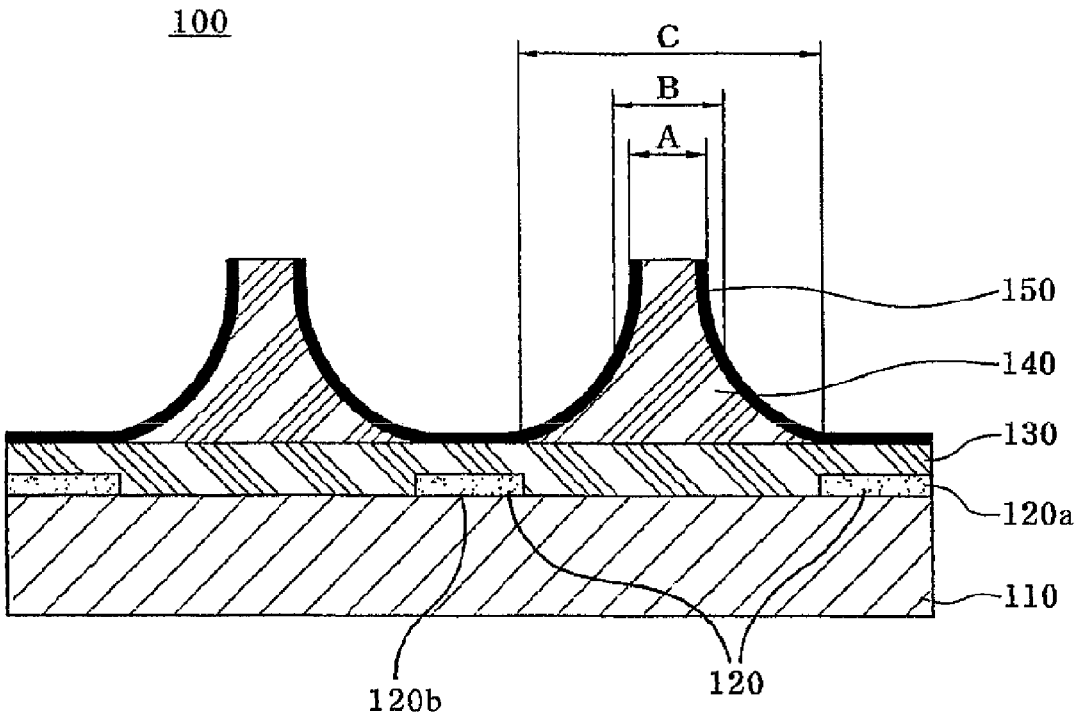
FIG. 1 is a sectional view of a portion of a rear plate of a plasma display panel according to the present invention.

FIG. 1 is a sectional view of a portion of a rear plate of a plasma display panel according to the present invention.

As shown in FIG. 1, a rear plate 100 of a plasma display panel (hereinafter, referred to as "PDP") according to the present embodiment includes a glass substrate 110, electrodes 120 formed in a shape of a pattern and spaced at a predetermined interval from each other on an upper surface of the glass substrate 110, a dielectric layer 130 formed on upper surfaces of the electrode 120 and the upper surface of the glass substrate 110, barrier ribs 140 formed on an upper surface of the dielectric layer 130 and spaced a predetermined interval from each other, and phosphorous layers 150 formed on side surfaces and bottom surfaces of the barrier ribs 140. Each of the dielectric layer 130 and the barrier ribs 140 is made from composite of glass-ceramic filler.

Hereinafter, a method of manufacturing the PDP will be described.

A stencil or screen mask for electrode is put on the upper surface of the glass substrate 110 having been dried after washed, electrode paste mainly made from silver Ag is put on the stencil for electrode, and then screen printing is performed on the entire surface of the stencil by means of squeezy, thereby forming an electrode layer. Thereafter, the electrode layer is dried for 5 to 20 minutes at a temperature of 120 to 180° C. Thereafter, the dried electrode layer is exposed to light through a photomask for manufacturing electrodes, and is then developed by means of an alkali solution of 1 to 2%. Then, ultraviolet rays are shed on the dried electrode layer through spaces in the patterns formed in the photomask for electrodes, thereby forming a latent image on the electrode layer. The latent image is dissolved by developing solution when the photosensitive material is a positive type, but is not dissolved by the developing solution when the photosensitive material is a negative type. That is to say, the dried electrode layer is developed, so that the electrodes 120 are formed in a shape of patterns. Then, the electrodes 120 are baked for 10 to 60 minutes at a temperature of 500~600° C. Each electrode 120 includes an effective electrode portion **120*b* formed at a central portion of the glass substrate 110 to apply an address signal, an electrode pad portion 120*a* formed at a peripheral portion of the glass substrate 110 and connected with a driving circuit to transfer a signal, and an electrode connecting portion interconnecting the effective electrode portion 120*b* and the electrode pad portion 120*a*. The effective electrode portion intersects the scan electrodes 23*a* and the sustain electrodes 23*b* of the front plate 20**, which have been described in the prior arts, and is located at a central portion between the barrier ribs, which will be later described.

Each of the baked electrodes 120 has a thickness of 5~10 μm and a specific resistance of $2.5\times10^{-6}$~$4\times10^{-6}$ Ωcm. When the electrode has a specific resistance of smaller than $2.5\times10^{-6}$ Ωcm, such a low specific resistance enables the address signal to be processed without noise, but the electrode must be manufactured from gold with a high purity or silver with a high purity, thereby increasing the manufacturing cost of the electrodes. In contrast, when the electrode has a specific resistance of larger than $4\times10^{-6}$ Ωcm, such problems as increase of address driving voltage may occur.

Next, a method of forming the dielectric layer 130 will be described.

A stencil or screen for the dielectric layer is laid on upper surfaces of the baked electrodes 120, dielectric paste is laid on the stencil for the dielectric layer, and then printing is performed through the entire screen by a squeezer, thereby forming the dielectric layer 130. Thereafter, the dielectric layer 130 is dried at a temperature of 120~180° C. for 5 to 20 minutes and is then baked at a temperature of 500~600° C. for 10 to 60 minutes.

The dielectric layer 130 may be formed in other methods as follows. In a first method, dielectric paste is prepared in a form of a green sheet, and the green sheet is laminated on the baked electrodes 120 and is then baked for 10 to 60 minutes at a temperature of 500~600° C., thereby forming the dielectric layer 130. In a second method, dielectric paste is coated on upper surfaces of the baked electrodes 120 by a coater such a table coater or roll coater, is dried at a temperature of 120~180° C. for 5 to 20 minutes, and is then baked for 10 to 60 minutes at a temperature of 500~600° C., thereby forming the dielectric layer 130.

Further, according to another method, a green sheet in which the dielectric layer 130 and a barrier rib layer are simultaneously formed by a tape casting is laminated on the baked electrodes 120, and is then baked for 10 to 60 minutes at a temperature of 500~600° C., thereby simultaneously forming the dielectric layer 130 and the barrier rib layer.

It is preferred that the dielectric layer 130 formed on the electrodes 120 covers all of the effective electrode portions and a portion of the electrode connecting portions and has a thickness of 10 to 30 μm.

Since an AC PDP is driven by wall charges accumulated in the dielectric layer 130, the electrodes 120 formed at the rear plate of the PDP must be coated. However, the electrode pad portions must be able to be connected with an FPC (Flexible Printed Circuit) which enables connection with a driving circuit. Therefore, the electrode pad portions must be prevented from being entirely covered by the dielectric layer 130, which is made from baked glass-ceramic and is non-conductor. Further, when the dielectric layer 130 has a thickness of smaller than 10 μm, the surface of the dielectric layer 130 is so adjacent to the electrodes 120, that it is difficult to form necessary wall charges and sputtering by plasma discharge becomes severe. In contrast, when the dielectric layer 130 has a thickness of larger than 30 μm, some problems may occur in driving the PDP.

The dielectric constant of the dielectric layer 130 is determined by the glass and the ceramic filler which are ingredients of the dielectric layer. When the dielectric constant is smaller than 8, it is difficult to form wall charges necessary in order to lower the driving voltage of the PDP. In contrast, when the dielectric constant is larger than 20, problems in relation to the driving of the PDP, such as erroneous discharge and crosstalk, may occur. Therefore, it is preferred that the dielectric layer 130 has a dielectric constant of 8 to 20.

Further, it is preferred that the dielectric layer 130 has a reflectance of 50~80%. When the dielectric layer 130 has a reflectance of smaller than 50%, brightness may deteriorate due to insufficient diffused reflection when vacuum ultraviolet rays generated by plasma discharge excite phosphors. In contrast, when the dielectric layer 130 has a reflectance of larger than 80%, problems in relation to the driving of the PDP, such as erroneous discharge and crosstalk due to the large reflectance, may occur.

Such problems as the erroneous discharge and crosstalk described above are caused by a trade-off phenomenon which may occur when material having a very high dielectric constant, such as titan oxide, is excessively inputted in order to increase the dielectric constant and reflectance.

Next, a method of forming the barrier ribs 140 will be described.

A stencil or screen for the barrier rib layer is laid on an upper surface of the dielectric layer 130, barrier rib paste is laid on the stencil for the barrier rib layer, is printed through the entire screen by a squeezer, and is then dried at a temperature of 120 to 180° C. for 5 to 20 minutes. Herein, the entire screen printing and drying are repeated several times, so that a barrier rib layer having a predetermined thickness is formed. Thereafter, the barrier rib layer is baked at a temperature of 500 to 600° C. for 10 to 60 minutes.

The barrier rib layer may be formed in other methods as follows.

In a first method, barrier rib paste is prepared in a form of a green sheet, and the green sheet is laminated on the baked dielectric layer 130 and is then baked for 10 to 60 minutes at a temperature of 500 to 600° C., thereby forming the barrier rib layer. In a second method, barrier rib paste is coated on the upper surface of the baked dielectric layer 130 by a coater such a table coater or roll coater, is dried at a temperature of 120 to 180° C. for 5 to 20 minutes, and is then baked for 10 to 60 minutes at a temperature of 500~600° C., thereby forming the barrier rib layer.

Thereafter, the barrier ribs 140 are formed by photolithography. Specifically, photoresist is laminated on an upper surface of the barrier rib layer, a photomask for forming the barrier ribs is laid on the photoresist, and then the photoresist is exposed to ultraviolet rays. Then, the photoresist is developed by alkali solution such as water, or sodium hydroxide or sodium carbonate of 0.1 to 2%, and is then dried at a temperature of 100 to 120° C. for 10 to 20 minutes. Then, etching solution is sprayed onto exposed portions of the barrier rib layer through the remaining photoresist, thereby forming the barrier ribs 140. Thereafter, the photoresist remaining on the barrier ribs 140 is eliminated using KOH, NaOH, or $Na_2CO_3$ aqueous solution of 1~20% at a temperature of 25 to 80° C. In thin case, the glass substrate 110, on which the barrier ribs 140 are formed may be precipitated in the KOH, NaOH, or $Na_2CO_3$ aqueous solution, or the KOH, NaOH, or $Na_2CO_3$ aqueous solution may be sprayed onto the remaining photoresist.

It is preferred that each of the barrier ribs 140 has a height of 100 to 160 μm. When the barrier ribs 140 have a height of smaller than 100 μm, the discharge space formed between the barrier ribs 140 and the area of the phosphors applied on the barrier ribs 140 become so small that the brightness and efficiency of the PDP may deteriorate. In contrast, when the barrier ribs 140 have a height of larger than 160 μm, not only it is difficult to form the barrier ribs 140 but also the formed barrier ribs 140 have a weak durability to mechanical impact.

The dielectric constant of the barrier ribs 140 is also determined by the glass and the ceramic filler which are ingredients of the barrier ribs 140. The smaller the dielectric constant is, the better. However, when the dielectric constant is smaller than 7, the driving voltage characteristic of the PDP deteriorates. In contrast, when the dielectric constant is larger than 18, deterioration of electric and optical characteristics of the PDP, such as erroneous discharge and crosstalk, may occur. Therefore, it is preferred that the barrier ribs 140 have a dielectric constant of 7 to 18.

Further, it is preferred that the barrier ribs 140 have a reflectance of 40 to 70%. When the barrier ribs 140 have a reflectance of smaller than 40%, brightness of the PDP may deteriorate due to insufficient diffused reflection when ultraviolet rays generated by plasma discharge excite phosphors. In contrast, when the barrier ribs 140 have a reflectance of larger than 70%, problems in relation to the driving of the PDP, such as erroneous discharge and crosstalk due to the large reflectance, may occur.

As described above, problems such as the erroneous discharge and crosstalk described above are caused by a trade-off phenomenon which may occur when material having a very high dielectric constant, such as titan oxide, is excessively inputted in order to increase the dielectric constant and reflectance.

The barrier ribs 140 are made from a complex of glass and ceramic filler. Herein, glass of the barrier ribs 140 contain a large quantity of lead oxide and boric oxide, which are soluble by etching solution, and a small quantity of aluminum oxide and silicon oxide, which are not soluble by the etching solution. Further, the barrier ribs 140 contain a small quantity of gradients of the ceramic filler, so that the barrier ribs 140 have an etching rate of 1.0 to 30.0 μm/min with respect to the etching solution consisting mainly of inorganic acid, such as fluoric acid, hydrochloric acid, nitric acid, or sulfuric acid. When the barrier ribs 140 have an etching rate of smaller than 1.0 μm/min, it takes more than one hour in etching the barrier rib layer having a thickness of 100 to 160 μm to form the barrier ribs 140. Therefore, it is difficult to use the barrier ribs 140 having an etching rate of smaller than 1.0 μm/min. In contrast, when the barrier ribs 140 have an etching rate of larger than 30 μm/min, it is difficult to form barrier ribs 140 having a uniform upper and lower width and a uniform shape due to such a fast etching rate.

The complex of glass and ceramic filler is isotropically etched by the etching solution, in which it is etched the same both in the horizontal direction and in the depth direction. However, in etching after the photolithography by adjusting gaps and width between patterns of the photomask, etching solution may be sprayed in one direction through a nozzle, performing an anisotropic etching in which the complex is etched more in the depth direction than in the lateral direction.

In the manufacturing method according to the present embodiment, the barrier ribs 140 are formed by subjecting the barrier rib layer to one-directional wet spray etching which is anisotropic etching. In this case, a portion of each electrode 120 and a large portion of the dielectric layer 130 are exposed to the etching solution. As a result, the electrodes 120 and the dielectric layer 130 may be etched by the etching solution, and thus it is necessary to prevent the electrodes 120 and the dielectric layer 130 from being etched. Herein, the barrier rib layer and the photoresist remaining on the barrier rib layer prevent the electrodes 120 from being etched, and the material of the dielectric layer 130, which is resistant to etching, prevents the dielectric layer 130 from being etched. The dielectric layer 130, which is a complex of glass and ceramic filler, is made from material having an etching rate of 0.03 to 0.8 μm/min with respect to the etching solution consisting mainly of inorganic acid. In order to ensure this, glass of the dielectric layer 130 contains a small quantity of lead oxide and boric oxide and a large quantity of aluminum oxide and silicon oxide. Further, in the dielectric layer 130, the ceramic filler contains a large quantity of aluminum oxide and titan oxide. When the dielectric layer 130 has an etching rate of smaller than 0.03 μm/min, the dielectric layer 130 has a good resistance to etching, but there may occur various problems, such as increase in the firing temperature for the dielectric layer 130 due to trade-off, possible cracking of the dielectric layer 130 due to reduction of its thermal expansive coefficient, increase of the bending of the rear plate, etc. In contrast, when the dielectric layer 130 has an etching rate of larger than 0.8 μm/min, a considerable portion of the dielectric layer 130 may be etched simultaneously when the barrier rib layer is etched since the dielectric layer 130 has a thickness much smaller than the thickness of the barrier rib layer, so that the dielectric layer 130 may loose its function.

Next, a method of forming the phosphorous layers 150 will be described.

A stencil or screen for the phosphorous layers is laid on upper and bottom surfaces of the barrier ribs 140 formed through etching, and phosphor paste is laid on the stencil for the phosphorous layers and is then pattern-printed by a squeezer, so that phosphorous layers 150 having a thickness of 10 to 30 μm are formed in a shape of patterns. Then, the phosphorous layers 150 are dried at a temperature of 120~180° C. for 5~20 minutes and are then baked at a temperature of 400~600° C. for 10~60 minutes, so that a rear plate 100 of a PDP is completed. Herein, when the phosphorous layers 150 have a thickness of smaller than 10 μm, various optical characteristics of the PDP, such as brightness, color coordinates, contrast, etc., may deteriorate. In contrast, when the phosphorous layers 150 have a thickness of larger than 30 μm, it is difficult to uniformly apply the phosphors on the surfaces of the barrier ribs, thereby causing problems such as brightness difference and color coordinates. In forming the phosphorous layers 150, red, green, and blue phosphors are separately formed. That is, the red, green, and blue phosphors are separately printed and dried, and are then baked at a temperature of 400~600° C. for 10 to 60 minutes, so that a rear plate 100 of a PDP is completed.

The phosphorous layers may be formed in other methods as follows.

First, phosphorous layer paste is put on a stencil for the phosphorous layers and is then printed on the entire screen of the stencil by a squeezer, thereby forming a phosphorous layer 150. Then, the phosphorous layer 150 is dried at a temperature of 120~180° C. for 5-20 minutes. Thereafter, a photomask for the phosphorous layer is laid on the phosphorous layer, and then the phosphorous layer is exposed to light and is then developed, so that phosphorous layers 150 are formed in a shape of patterns. In this case also, the red, green, and blue phosphors are separately printed and dried, and are then baked at a temperature of 400~600° C. for 10 to 60 minutes.

Second, red, green, and blue phosphors are either simultaneously or separately sprayed onto the barrier ribs 140 through dedicated nozzle units, respectively. Then, the applied red, green, and blue phosphors are dried at a temperature of 120~180° C. for 10~60 minutes, and are then baked at a temperature of 400~600° C. for 10 to 60 minutes.

In the methods according to the previous embodiments, each functional layer 120, 130, 140, or 150 has been individually baked. However, in the present embodiment, either the dielectric layer 130 and the barrier rib layer may be simultaneously baked, or the electrodes 120, the dielectric layer 130, and the barrier rib layer may be simultaneously baked.

The barrier ribs 140 may have various shapes according to designs of the photomask, which will be described hereinafter.

The patterns of the photomask have a pattern width (PW) corresponding to width of barrier ribs 140 to be formed, a pattern gap (PG) between the pattern width (PW) and pattern width (PW), and a pitch obtained by adding the pattern width (PW) and the pattern gap (PG). That is to say, the photomask has patterns designed corresponding to the barrier ribs 140 to be formed. Therefore, when the photoresist is exposed to light through the photomask laid on the photoresist and is then developed, a portion of the photoresist corresponding to the pattern width (PW) of the photomask is eliminated, so that a portion of the barrier rib layer corresponding to the pattern width (PW) of the photomask is exposed. Then, the exposed portion of the barrier rib layer is etched, so that the barrier ribs 140 are formed.

The pattern gap can be calculated by an equation, $PG=(P-A)-(2D/EF)$, wherein S represents a horizontal distance by which the barrier rib has been etched from the bottom of the photoresist, D represents a height of the barrier rib, that is, a vertical distance by which the barrier rib has been etched from the bottom of the photoresist, A represents an uppermost width of the formed barrier rib, EF represents an etching factor, D/S, and P, A, D, S are known constants. Then, the patterns of the photomask can be designed to be suitable for the desired barrier ribs 140, and the barrier ribs 140 can be formed through one directional wet spray etching which is anisotropic etching. In this case, the following condition must be satisfied: $(P-A)>(2D/EF)$; $P>A$; $P>0$; $A>0$; $D>0$; and $S>0$.

However, in forming the barrier rib 140 having a desired shape through etching, the etching factor EF is too low due to the characteristics of the etching. In order to overcome this problem, sherifs, such as protrusions, grooves, and bent portions are added to predetermined portions of the patterns to compensate the patterns in designing the patterns of the photomask. Then, portions of the barrier ribs directly under the protrusions, grooves, and bent portions of the remaining photoresist are first etched, so, that barrier ribs 140 having a desired shape can be formed.

Hereinafter, various shapes of barrier ribs 140 according to the present invention, which are formed through photolithography and one directional wet spray etching, will be described with reference to FIGS. 2 to 9. FIGS. 2 to 9 are photographs taken by an electron microscope with a magnifying power of 50-200, which show barrier ribs of a rear plate with various shapes, formed by a method according to an embodiment of the present invention.

Figure 2:
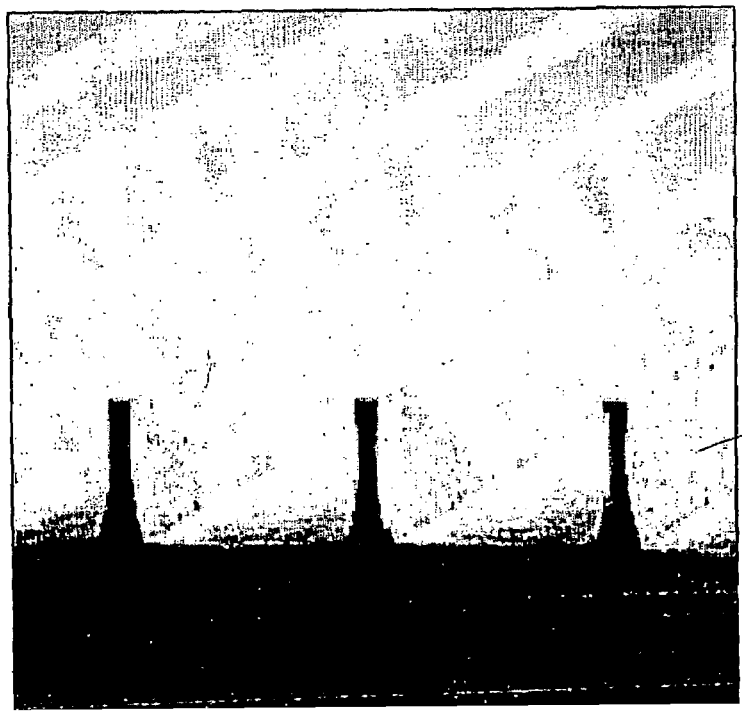
FIGS. 2 to 9 are photographs showing various shapes of barrier ribs of a rear plate according to the present invention.

When the patterns of the photomask are designed to be stripes spaced regular intervals apart from each other, the barrier ribs 141 are formed in a shape of stripes spaced regular intervals apart from each other as shown in FIG. 2.

Figure 3:
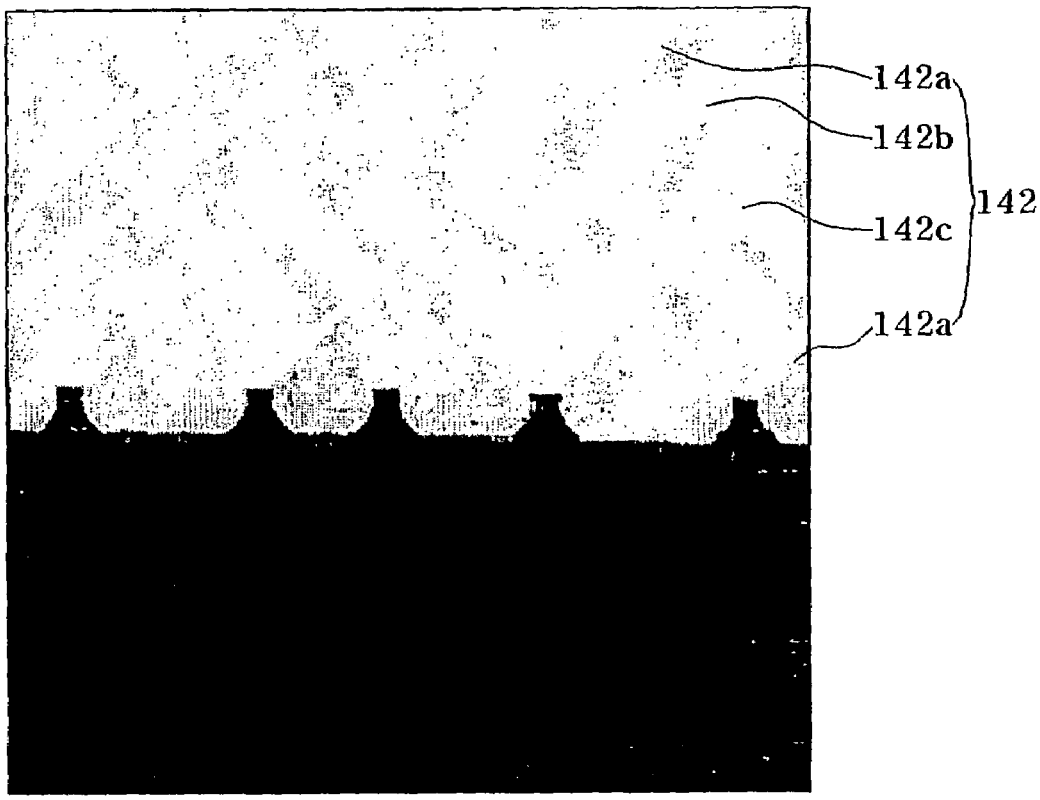

When the patterns of the photomask are designed to be stripes spaced unequal intervals apart from each other, the barrier ribs 141 are formed in a shape of stripes spaced unequal intervals apart from each other as shown in FIG. 3. The reason why the barrier ribs 141 are formed in a shape of stripes spaced unequal intervals apart from each other will be briefly described hereinafter. Red, green, and blue phosphors are printed on inner surfaces of adjacent barrier ribs 142. The light-emitting efficiencies of the phosphors have magnitudes which follow a sequence, red>green>blue, due to their color characteristics. Therefore, red phosphor is printed in a narrow gap between the barrier ribs 142*a* and 142*b*, green phosphor is printed in a middle gap between the barrier ribs 142*b* and 142*c*, and blue phosphor is printed in a wide gap between the barrier ribs 142*c* and 142*a*, so that the areas of the printed phosphors have magnitudes which follow a sequence, blue>green>red. As a result, the light-emitting efficiency of the blue phosphor, which is relatively low, is compensated, so that the red, green, blue phosphors can emit rays with intensities similar to each other.

Figure 4:
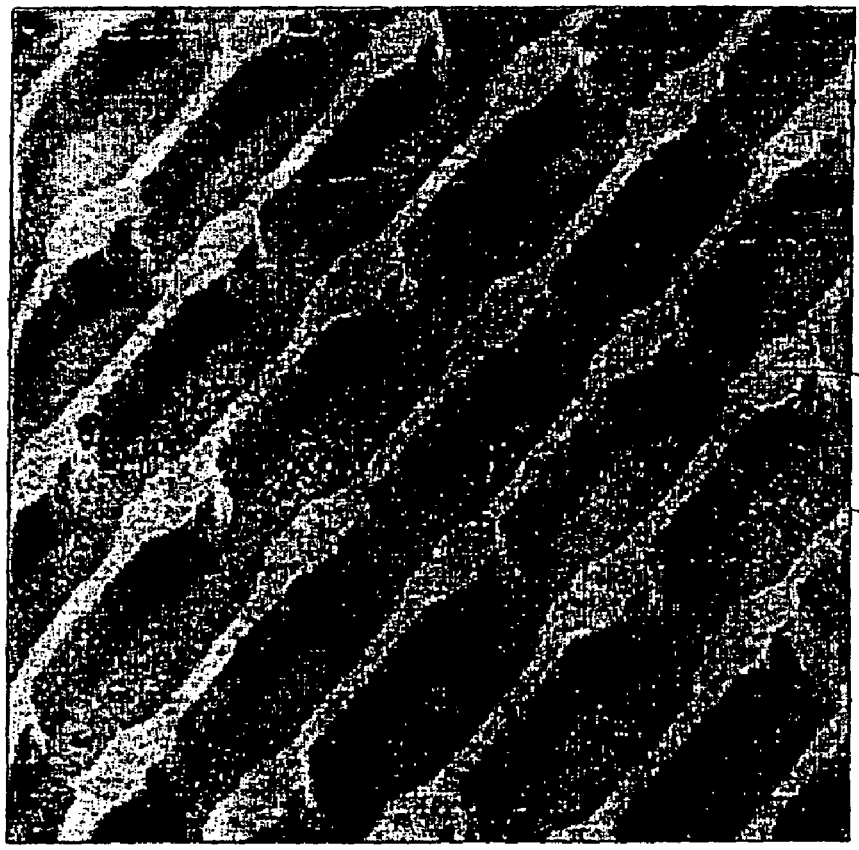

Further, when the patterns of the photomask are designed to be stripes spaced regular intervals apart from each other and to have a protrusion formed at a middle portion of each stripe, the barrier ribs 143 are formed in a shape of stripes spaced regular intervals apart from each other, which have protrusions 143*a* formed on side surfaces of the barrier ribs 143 opposed to each other, as shown in FIG. 4.

Figure 5:
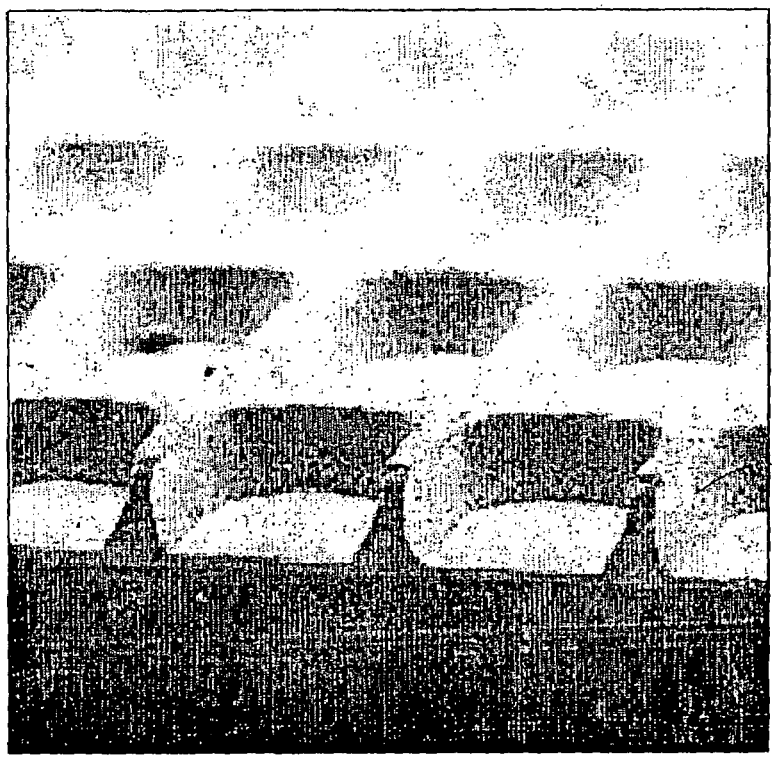

Further, when the patterns of the photomask are designed to have a shape of checkers or cross stripes, barrier ribs 145 are formed in a shape of rectangular matrix with regular intervals as shown in FIG. 5.

Figure 6:
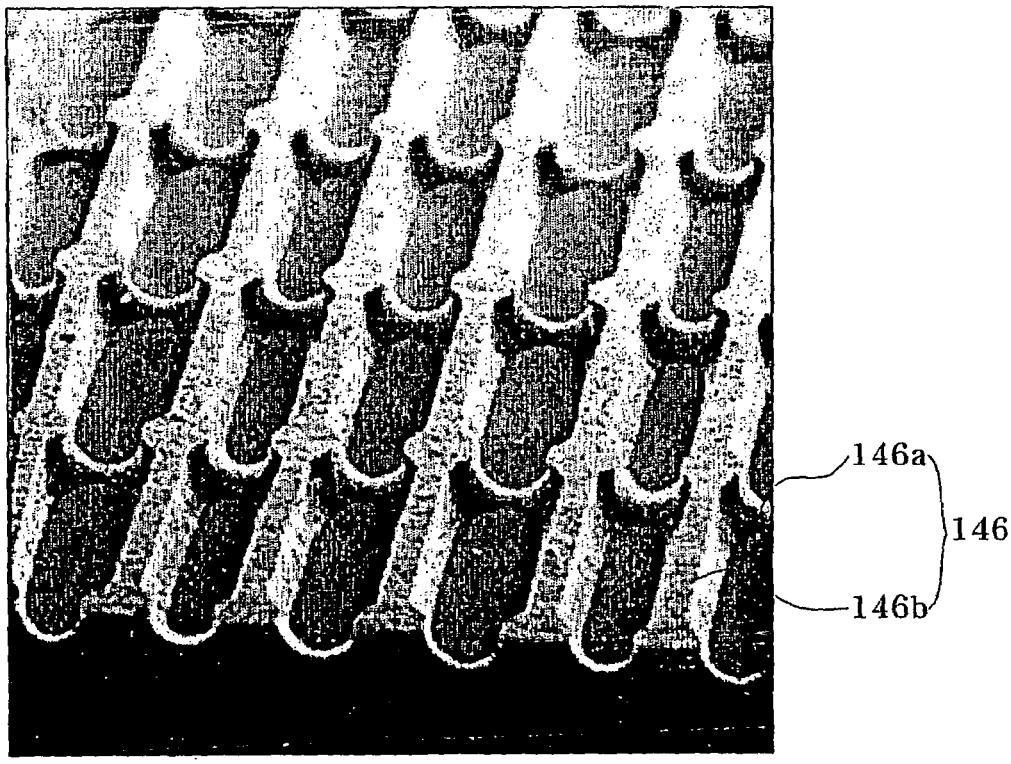

Further, when the patterns of the photomask are designed to have a shape of stepped matrix, barrier ribs 146 are formed in a shape of stepped matrix as shown in FIG. 6. That is, if the transverse direction of the barrier ribs 146 is given as an X direction and the longitudinal direction thereof is given as a Y direction, the formed barrier ribs 146 have a shape of stepped matrix in which the barrier ribs 146*a* in the X direction and the barrier ribs 146*b* in the Y direction have thickness different from each other. The barrier ribs 146 having a shape of stepped matrix can be formed by using a photomask designed to have the sherifs and properly adjusting kinds of materials of the barrier ribs, and kinds, concentration, and spray pressure of the etching solution.

Figure 7:
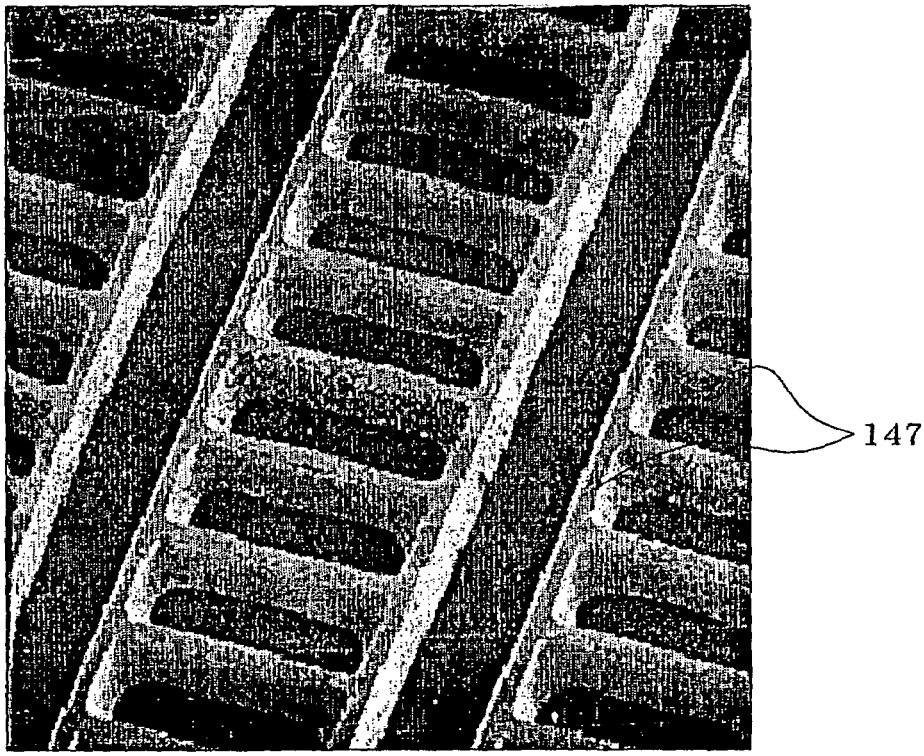

Further, when the patterns of the photomask are designed to have a waffle shape or a shape of ladders disposed in parallel, barrier ribs 147 are formed in a shape of ladders disposed in parallel as shown in FIG. 7.

Figure 8:
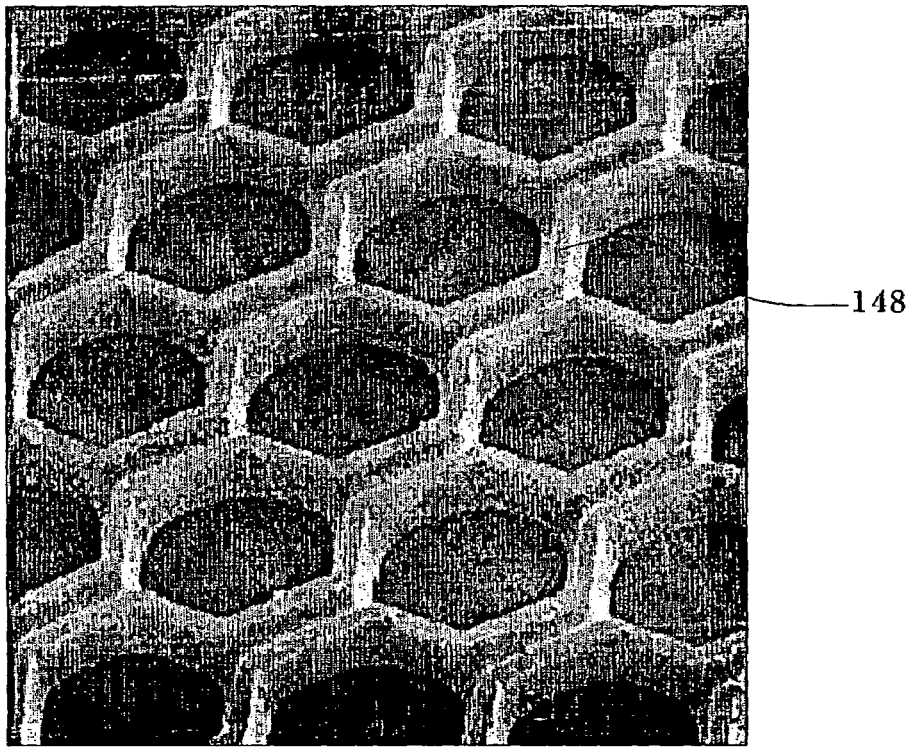

Further, when the patterns of the photomask are designed to have a shape of meanders or honeycomb, barrier ribs 148 are formed in a shape of honeycomb, each having a hexagonal shape, as shown in FIG. 8.

Figure 9:
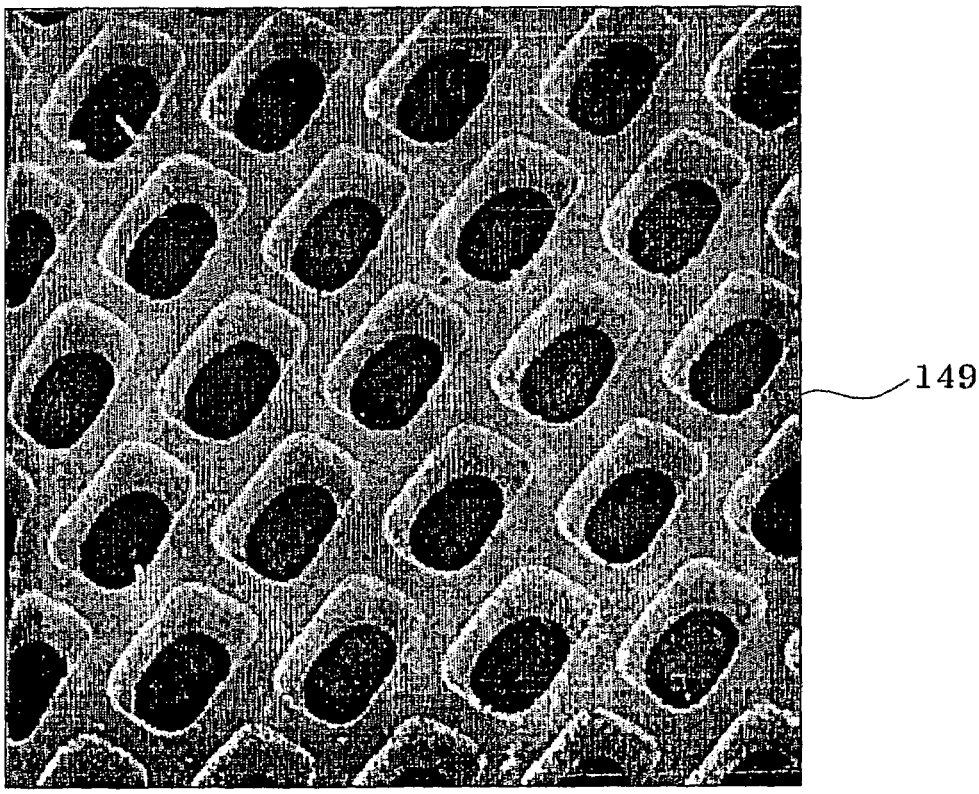

Further, when the patterns of the photomask are designed to have a shape of stacked bricks, barrier ribs 149 are formed in a shape of stacked bricks as shown in FIG. 9.

The side walls 141 to 149 formed on the shown rear plates may have either equal gaps or unequal gaps between the side walls.

Hereinafter, dimensions of the barrier ribs formed by photolithography and one directional wet spray etching according to the present embodiment will be described.

Referring to FIG. 1, between the barrier ribs 140 adjacent to each other, it is preferred that A/B equals to 0.67~1.25, when A represents width between the uppermost portions of the barrier ribs 140, B represents width between middle portions of the barrier ribs 140, and C represents width between the lowermost portions of the barrier ribs 140. This condition can be accomplished by designing the pattern gap PG of the photomask to meet an equation, PG=(P−A)−(2D/EF), and properly adjusting kinds and composition of glass and ceramic filer for the barrier ribs, and kinds, concentration, and spray pressure of etching solution.

When the magnitude of A is put as 100%, it is preferred that B has a magnitude of 80 to 150% (that is, A/B=0.67~1.25). When B is less than 80% based on A, the barrier ribs are so fragile that they may be easily broken by mechanical impact and vibration. In contrast, when B is more than 150% based on A, C becomes to large to obtain a lowermost width between the barrier ribs, which can allow the dielectric layer 130 to be exposed, so that the barrier ribs have incomplete shapes.

Further, based on the magnitude of A, it is preferred that C has a magnitude of 150~250% (that is, B/C=0.32~1.0). When C is less than 150% based on A, impact strength and curvature of the surface on which the phosphors are applied decrease, thereby reducing the brightness of the PDP. When C is more than 250% based on A, an exposed area of the dielectric layer 130 is so small that problems occur in driving the PDP.

Hereinafter, measured properties of rear plates of a PDP manufactured in a method according to the present invention and in a conventional method, respectively, will be described.

In the experiment which will be described below, a glass substrate PD-200 manufactured by ASAHI, Co., Ltd., Japan, has been used. Further, a rear plate of 42 inches and VGA class, having barrier ribs formed in a shape of stripes with equal intervals, has been employed in method 1, and a rear plate of 42 inches and VGA class, having barrier ribs formed in a shape of rectangular matrix, has been employed in method 2.

In methods 1 and 2 according to the present invention, an electrode layer formed on an upper surface of a washed and dried glass substrate 110 has been dried at 120° C. for 10 minutes, and then the electrodes 120 formed through exposure and development have been baked at 580° C. for 30 minutes. Further, the dielectric layer 130 formed on upper surfaces of the electrodes 120 has been dried at 140° C. for 10 minutes, a barrier rib layer has been formed on the upper surface of the dielectric layer 130, and then a step of drying the barrier rib layer at 140° C. for 10 minutes has been repeated several times. Then, the dielectric layer 130 and the barrier rib layer have been simultaneously baked at 520° C. for 30 minutes, thereby forming the baked dielectric layer 130 and the baked barrier rib layer. The process described above is the same in both method 1 and method 1.

Thereafter, the photoresist laminated on the upper surface of the barrier rib layer has been exposed to light, has been developed by 2% sodium carbonate solution, has been dried at 110° C. for 15 minutes, has been wet-etched by spraying acid-based etching solution in one direction. Then, barrier ribs 141 in a shape of stripes with equal gaps have been formed in method 1, and barrier ribs 145 in a shape of rectangular matrix have been formed in method 2. Further, NaOH aqueous solution at a temperature of 30° C. and with a concentration of 3% has been sprayed onto the barrier ribs, thereby eliminating the remaining photoresist.

Thereafter, phosphorous layers 150 have been formed on side and bottom surfaces of the barrier ribs 140 and then dried at a temperature of 150° C. for 20 minutes. Herein, red, green, and blue phosphorous layers have been separately formed and dried, as described above. Further, the phosphorous layers 150 have been baked at 450° C. for 30 minutes, so that a rear plate of a PDP has been completed.

The conventional method has employed the same glass substrate and the same electrodes as those employed in the experiment according to the present invention. However, the conventional method has employed a dielectric layer made from material having a relatively low softening temperature, in consideration of compatibility with the material of the barrier ribs worked by sandblasting. The barrier ribs have been formed in a shape of stripes with equal gaps by means of calcium carbonate of 20 μm. The phosphorous layers has been formed from the same materials and with the same conditions as those in methods 1 and 2.

Table 1 shows dimensions, shapes, and properties of each functional layer of rear plates of PDPs manufactured according to methods 1 and 2 of the present invention and the conventional method.

TABLE 1

| Property | | Measured properties of each functional layer of rear plates of PDPs: Class | | | | | | | | | | |
|---|---|---|---|---|---|---|---|---|---|---|---|---|
| | | Specific resistance | Dielectric ratio | Reflection ratio | Etching rate | Width of electrode | Thickness of electrode | Thickness of dielectric layer | Thickness of partition wall | Width of partition wall Ratio A/B | Width of partition wall Ratio B/C | Type of partition wall |
| Electrode | Conven' 1 meth. | 2.6 | — | — | — | 95.0 | 5.5 | — | — | — | — | — |
| | Meth. 1 | 2.5 | — | — | — | 98.0 | 5.2 | — | — | — | — | — |
| | Meth. 2 | 2.5 | — | — | — | 96.5 | 5.4 | — | — | — | — | — |
| Dielectric layer | Conven' 1 meth. | — | 16.2 | 61.0 | 0.62 | — | — | 18.0 | — | — | — | — |
| | Meth. 1 | — | 15.4 | 59.0 | 0.16 | — | — | 16.9 | — | — | — | — |
| | Meth. 2 | — | 15.9 | 62.0 | 0.09 | — | — | 17.2 | — | — | — | |
| Partition wall | Conven' 1 meth. | — | 12.2 | 54.6 | 0.58 | — | — | — | 131.0 | 0.93 | 0.75 | Equal-gap Stripes |
| | Meth. 1 | — | 12.5 | 55.2 | 14.70 | — | — | — | 128.5 | 0.78 | 0.74 | Equal-gap Stripes |
| | Meth. 2 | — | 12.7 | 57.2 | 12.30 | — | — | — | 127.3 | 0.64 | 0.68 | Rectangular matrix |

In table 1, the specific resistance has a unit of Ωcm, each of the dielectric constant and reflectance has a unit of %, the etching rate has a unit of μm/min, and each of the thickness and width has a unit of μm.

A rear plate having the properties as shown in table 1 has been attached to a front plate, so that a PDP has been manufactured. Then, the PDP has been aged for 30 hours, and then a driving circuit has been attached to the PDP. In this case, the manufacturing conditions are all the same. Table 2 shows measured electric, optical, and mechanical properties of the PDPs manufactured as described above.

Table 2

TABLE 2

| Property | Various measured properties of PDPs: class | | | | | | | |
|---|---|---|---|---|---|---|---|---|
| | Electrical properties | | | Optical properties | | | Reliability | |
| | Volt. margin | Power consum | Module effici. | Average Brightness | Color temper. (K.) | Contr. | High/low temp. erroneous discharge | Resistance To impact |
| Convent'l meth. | 100% | 100% | 100% | 100% | 8500 | 100% | No | No progressive defect |
| Meth. 1 | 140% | 91% | 124% | 127% | 8900 | 126% | No | No progressive defect |
| Meth. 2 | 152% | 89% | 130% | 140% | 8800 | 130% | No | No progressive defect |

As shown in table 2, a PDP employing a rear plate manufactured according to a method 1 of the present invention has shown improvements in comparison with a PDP employing a rear plate manufactured according to a conventional method, which include 40% increase in voltage margin, 9% reduction in power consumption, 24% increase in the efficiency of the PDP, 27% increase in the average brightness of the PDP, and 26% increase in the contrast due to 400K increase of color temperature.

Further, a PDP employing a rear plate manufactured according to a method 2 of the present invention has shown improvements in comparison with a PDP employing a rear plate manufactured according to a conventional method, which include 52% increase in voltage margin, 11% reduction in power consumption, 30% increase in the efficiency of the PDP, 40% increase in the average brightness of the PDP, and 30% increase in the contrast due to 300K increase of color temperature.

In other words, a PDP employing a rear plate manufactured according to a method of the present invention is superior to a PDP employing a rear plate manufactured according to a conventional method in views of all the characteristics of the PDP.

INDUSTRIAL APPLICABILITY

As can be seen from the foregoing, in a rear plate of a plasma display panel according to the present invention, barrier ribs are formed by etching a baked barrier rib layer, so that the completed barrier ribs have no deformation and the electrodes can be exactly located at central portions between the barrier ribs.

Further, when a PDP has been completed by attaching a front plate to a rear plate as described above, the PDP shows improvements in both optical characteristics, such as average brightness, color temperature, and contrast, and electric characteristics, such as voltage margin, power consumption, and efficiency.

While this invention has been described in connection with what is presently considered to be the most practical and preferred embodiment, it is to be understood that the invention is not limited to the disclosed embodiment and the drawings, but, on the contrary, it is intended to cover various modifications and variations within the spirit and scope of the appended claims.

The invention claimed is:

1. A rear plate of a plasma display panel, the rear plate comprising:

a glass substrate;

electrodes formed in a shape of patterns on an upper surface of the glass substrate;

a dielectric layer formed on upper surfaces of the electrode and the upper surface of the glass substrate;

barrier ribs formed in a shape of a pattern through etching on an upper surface of the dielectric layer; and phosphorous layers formed on side surfaces and bottom surfaces of the barrier ribs, to emit visible rays according to electric signals, wherein:

the electrodes include an effective electrode portion formed at a central portion of the glass substrate to apply an address signal, an electrode pad portion formed at a peripheral portion of the glass substrate and connected with a driving circuit to transfer a signal, and an electrode connecting portion interconnecting the effective electrode portion and the electrode pad portion, and has a specific resistance of $2.5\times10^{-6}$~$4\times10^{-6}$ Ωcm;

the dielectric layer covers all of the effective electrode portion and a part of the electrode connecting portion of each electrode, and is made from complex of glass and ceramic filler, which has a dielectric constant of 8~20, a reflectance of 50~80%, an etching rate of 0.03~0.8 μm/min with respect to inorganic acid, and a thickness of 10~30 μm;

the barrier ribs are formed in a shape of stripes on the upper surface of the dielectric layer while being located between the effective electrode portions, and are made from complex of glass and ceramic filler, which has a dielectric constant of 7~18, a reflectance of 40%~70%, an etching rate of 1.0~30.0 μm/min with respect to inorganic acid, and a thickness of 100~160 μm, and each of the barrier ribs meets conditions, A/B=0.67~1.25 and B/C=0.32~1.0, wherein A, B, and C represent width of an uppermost portion, a middle portion, and a lowermost portion of each barrier rib, respectively;

the phosphorous layers have a thickness of 10~30 μm.

2. A rear plate of a plasma display panel as claimed in claim 1, wherein the barrier ribs are spaced equal intervals apart from each other.

3. A rear plate of a plasma display panel as claimed in claim 1, wherein the barrier ribs are spaced unequal intervals apart from each other.

4. A rear plate of a plasma display panel as claimed in claim 2 or 3, wherein protrusions are formed on side surfaces of the barrier ribs opposed to each other.

5. A rear plate of a plasma display panel, the rear plate comprising:

a glass substrate;

electrodes formed in a shape of patterns on an upper surface of the glass substrate;

a dielectric layer formed on upper surfaces of the electrode and the upper surface of the glass substrate;

barrier ribs formed in a shape of a pattern through etching on an upper surface of the dielectric layer; and phosphorous layers formed on side surfaces and bottom surfaces of the barrier ribs, to emit visible rays according to electric signals, wherein:

the electrodes includes an effective electrode portion formed at a central portion of the glass substrate to apply an address signal, an electrode pad portion formed at a peripheral portion of the glass substrate and connected with a driving circuit to transfer a signal, and an electrode connecting portion interconnecting the effective electrode portion and the electrode pad portion, and has a specific resistance of $2.5\times10^{-6}$~$4\times10^{-6}$ Ωcm;

the dielectric layer covers all of the effective electrode portion and a pad of the electrode connecting portion of each electrode, and is made from complex of glass and ceramic filler, which has a dielectric constant of 8~20, a reflectance of 50~80%, an etching rate of 0.03~0.8 μm/min with respect to inorganic acid, and a thickness of 10~30 μm;

the barrier ribs are formed in a shape of matrix on the upper surface of the dielectric layer while being located between the effective electrode portions, and are made from complex of glass and ceramic filler, which has a dielectric constant of 7~18, a reflectance of 40%~70%, an etching rate of 1.0~30.0 μ/min with respect to inorganic acid, and a thickness of 100~160 μm, and each of the barrier ribs meets conditions, A/B=0.67~1.25 and B/C=0.32~1.0, wherein A, B, and C represent width of an uppermost portion, a middle portion, and a lowermost portion of each barrier rib, respectively;

the phosphorous layers have a thickness of 10~30 μm.

6. A rear plate of a plasma display panel as claimed in claim 5, wherein the barrier ribs are spaced equal intervals apart from each other.

7. A rear plate of a plasma display panel as claimed in claim 5, wherein the barrier ribs are spaced unequal intervals apart from each other.

8. A rear plate of a plasma display panel as claimed in claim 6 or 7, wherein, when the transverse direction of the barrier ribs is given as an X direction and the longitudinal direction thereof is given as a Y direction, thickness of each of the barrier ribs in the X direction is different from thickness thereof in the Y direction.

* * * * *